US005640457A

United States Patent [19]

Gnecco et al.

[11] Patent Number: 5,640,457

[45] Date of Patent: Jun. 17, 1997

[54] ELECTROMAGNETICALLY SHIELDED HEARING AID

[76] Inventors: Louis Thomas Gnecco; Paula Sharyn Gnecco, both of 112-F Elden St., Herndon, Va. 22070

[21] Appl. No.: 557,999

[22] Filed: Nov. 13, 1995

[51] Int. Cl.[6] ..... H04R 25/00

[52] U.S. Cl. ..... 381/69; 174/35 R

[58] Field of Search ..... 381/68–69.2, 23.1, 381/151; 455/280, 281; 174/35 R, 35 TS; 361/816, 818

[56] References Cited

U.S. PATENT DOCUMENTS

| | | | |
|---|---|---|---|
| 1,712,026 | 5/1929 | Clark | 455/280 |
| 1,805,942 | 5/1931 | Ferris | 455/280 |
| 1,943,405 | 1/1934 | Wheeler | 455/280 |
| 2,327,320 | 8/1943 | Shapiro | 381/69.1 |
| 2,617,926 | 11/1952 | Cohen | 455/280 |
| 3,587,017 | 6/1971 | Kurusu | 455/280 |
| 4,532,930 | 8/1985 | Crosby et al. | 128/419 |
| 4,805,232 | 2/1989 | Ma | 455/280 |
| 5,500,629 | 3/1996 | Meyer | 333/181 |

FOREIGN PATENT DOCUMENTS

| | | | |
|---|---|---|---|
| 404271398 | 9/1992 | Japan | 381/151 |

*Primary Examiner*—Curtis Kuntz
*Assistant Examiner*—Rexford N. Barnie

[57] ABSTRACT

A behind the ear, in the ear, all in the ear, in the canal, or completely in the canal hearing aid which is made resistant to electromagnetic interference produced by cellular telephones in the 800 MHz to 1000 MHz frequency range. The resultant hearing aid will allow hearing impaired people to take advantage of cellular telephones and other recently-developed personal communication devices while also using their hearing aids.

3 Claims, 7 Drawing Sheets

ELECTROMAGNETICALLY SHIELDED HEARING AID

BACKGROUND OF THE INVENTION

1. Field of the Invention

This invention relates to hearing aids, and specifically to Behind The Ear, In The Ear, In The Canal, or Completely In The Canal hearing aids which are being shielded to be resistant to electromagnetic interference produced by cellular telephones in the 800 MHz to 1000 MHz frequency range.

2. Description of Related Art

The invention consists of the following hearing aids which can be worn behind the ear, in the ear, or in the ear canal, these devices are widely known in the hearing aid industry as follows: Behind The Ear (BTE), In The Ear or All In The Ear (ITE), In The Canal (ITC), and Completely In The Canal (CIC).

This invention intends to shield these types of hearing aids from electromagnetic interference caused by cellular telephones in the 800–1000 MHz frequency range by using an electrically conductive foil to shield the circuitry components. Furthermore, an electrically conductive gasket, paint or plastic could also be used to shield the circuitry components.

Also, a filtering circuit composed of inductors and capacitors is used to shield the circuitry components wherein ferrite beads or ferrite toroids are used as the inductors.

The following devices are related to, but do not comprise any part of this invention: hearing aids worn elsewhere on the body other than in or behind the ear, known as "Body Aids", aids which intentionally use an electric field antenna or a plane wave antenna, hearing aids which couple sound waves through the bones of the head, known as "Bone Conduction" hearing aids, and also hearing aids which are built into eyeglass frames, and any devices which require surgery to install, such as Cochlear Implants.

Description of Prior Art

FIG. 5 (Prior Art) Illustrates the elements which comprise a hearing aid. A Behind The Ear hearing aid is used for the illustration, but the same components are found in other hearing aids wherein the only difference could be the shape or size.

FIG. 5 (Prior Art) shows a hearing aid consists of an outer case 1, usually made of plastic such as Lucite (Poly Methyl Methacrylate), Non-Toxic Lucite, Poly Ethyl Methacrylate, Poly Vinyl Chloride, Silicone, or Polyethylene.

The case 1 houses and protects the internal circuitry components. The hearing aid has a battery door 3 which can be opened to replace the battery, an opening for a microphone 5, an opening for the speaker or receiver 6, and an opening for the volume control knob 7. The case 1 often has switches and controls, such as an optional telecoil pickup switch which couples the hearing aid electromagnetically to a telephone handset. The internal components 2 also consist of amplifiers and signal conditioning circuits as shown in the block diagram. These circuits contain non linear elements such as transistors. Some of the internal components are coupled by free internal wires 10.

Besides all these openings as disclosed above, In The Ear, In The Canal, or Completely In The Canal hearing aids have a vent hole (not shown) to prevent the buildup of air pressure and moisture in the ear canal. This vent hole goes completely through the hearing aid. To build an effective hearing aid, one requires several openings due to current technology.

Todays hearing aid users are adversely affected by radio signals that are produced by cellular telephones in the 800 to 1000 MHz frequency range. These signals are often pulse modulated at rates of 200 Hz to 300 Hz. Conventional hearing aids can unintentionally act as radio receivers, with their internal wires 10 acting as unintentional antennas, and their nonlinear elements unintentionally acting as detection and demodulating circuits. This causes the hearing aid to produce annoying or intolerable sounds, such as a 200 Hz to 300 Hz hum.

Shapiro (U.S. Pat. No. 2,327,320) teaches a body-hearing aid with a shield against electromagnetic interference which undoubtedly is only effective for low frequency sources of electromagnetic interference such as motors, hair dryers, and possibly fluorescent lights. It should be noted that this shield would not be effective against the current ultra-high frequency signals being experienced by today's hearing aid users. Ferrite beads and transistors were not available at this time and therefore, current circuitry components can not be shielded by the methods disclosed by Shapiro.

SUMMARY OF THE INVENTION

The invention consists of the following hearing aids which can be worn behind the ear, in the ear, or in the ear canal, these devices are widely known in the hearing aid industry as follows: Behind The Ear (BTE), In The Ear or All In The Ear (ITE), In The Canal (ITC), and Completely In The Canal (CIC).

This invention intends to shield these types of hearing aids from electromagnetic interference caused by cellular telephones in the 800–1000 MHz frequency range by using an electrically conductive foil to shield the circuitry components. Furthermore, an electrically conductive gasket, paint or plastic could also be used to shield the circuitry components.

Also, a filtering circuit composed of inductors and capacitors is used to shield the circuitry components wherein ferrite beads or ferrite toroids are used as the inductors.

DETAILED DESCRIPTION

Figure 7:
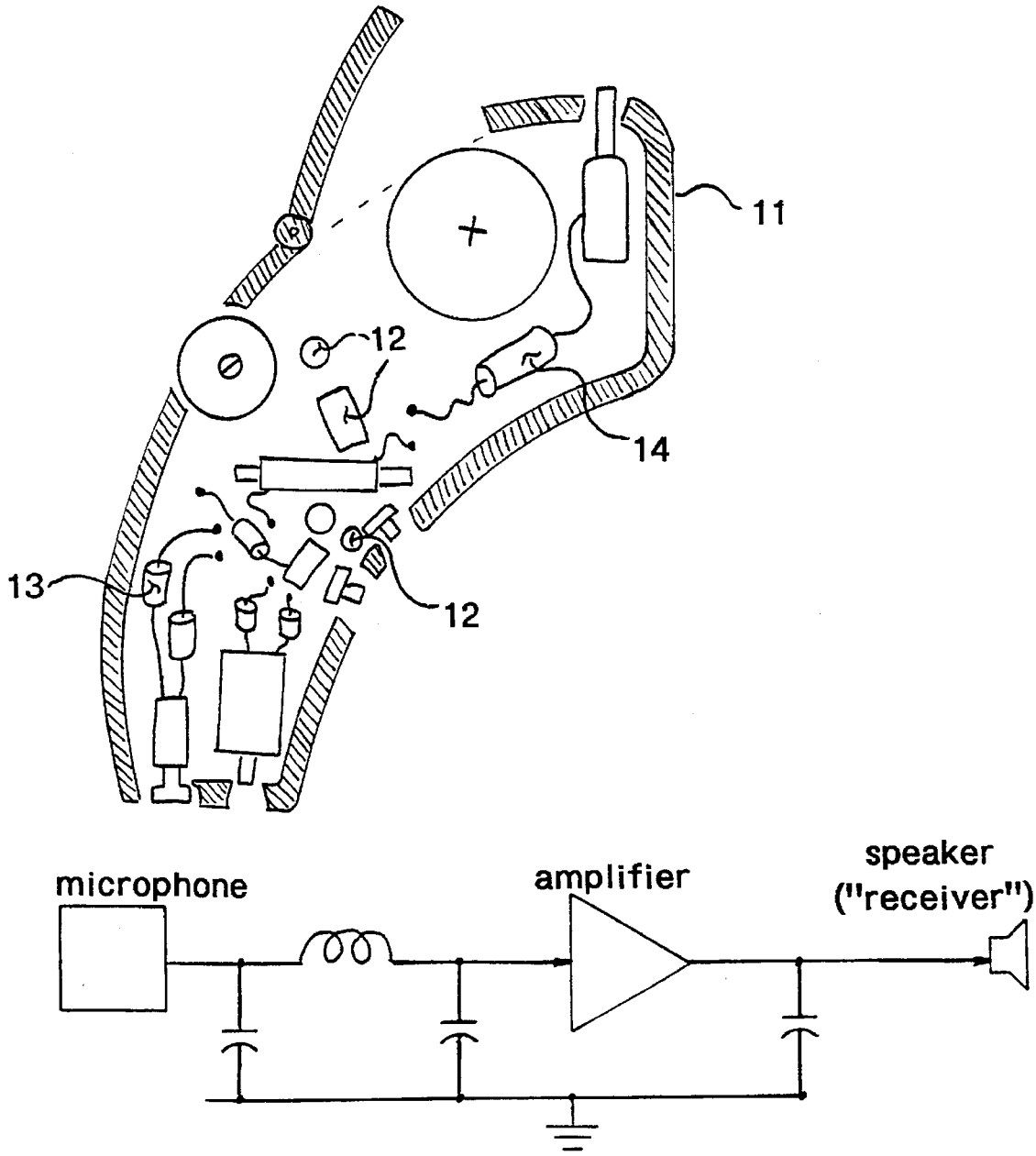
FIG. 7 describes the invention.

The invention, shown in FIG. 7, consists of the following elements: an outer case 11, which holds and protects the internal components 12 and is shielded by one or more of the following:

11*a*: Painting the case with a conductive coating, usually a paint which is filled with silver, nickel, or copper, such as the following products made by Chomerics, Inc. of Woburn Mass.: "Cho-Shield 596" or "Cho-Flex 601."

11*b*: Lining the case with an electrically conductive material such as conductive foil, usually copper or aluminum foil, such as "Cho-foil" produced by Chomerics, Inc.

11*c*. Making the case out of a conductive material, such as a plastic which has been impregnated with metal or carbon.

11*d*. Using conductive gaskets such as "CHO-seal 1215" made by Chomerics, Inc.

The outer case 11 houses the internal components 12 which must sometimes be shielded in addition to the case. The techniques used to shield the internal components 12 are those described in 11*a*, 11*b*, 11 *c*, and 11*d* above.

Figure 2:
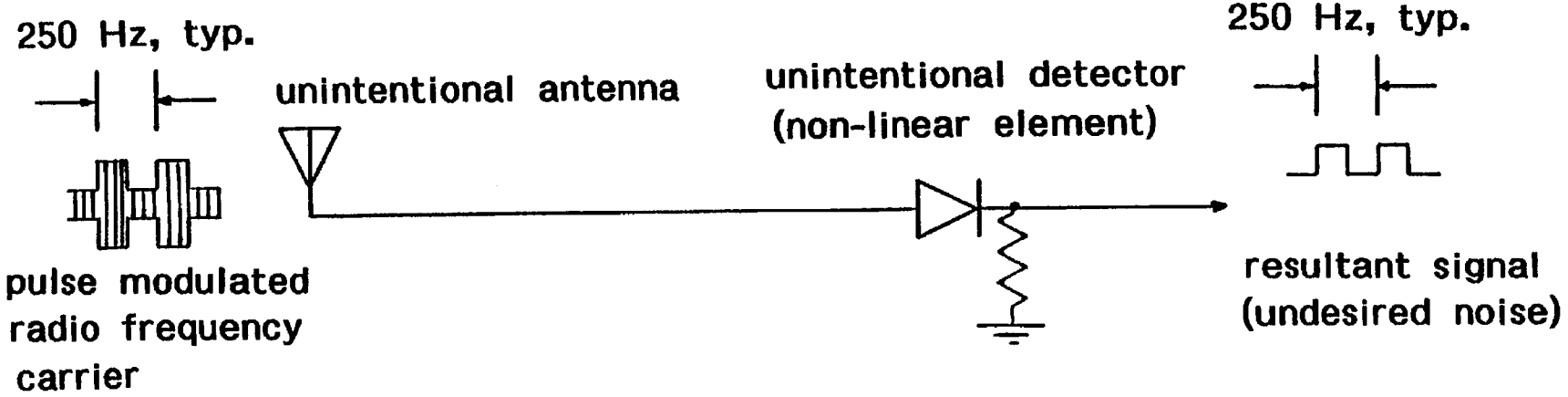
FIG. 2 shows how electromagnetic interference is transmitted by a cellular telephone, is received by an internal wire of the hearing aid which acts as an unintentional antenna, is detected and demodulated by a nonlinear element of the hearing aid (for example, a transistor), and results in a loud, audible signal which is annoying or intolerable to the hearing aid wearer.
Figure 3:
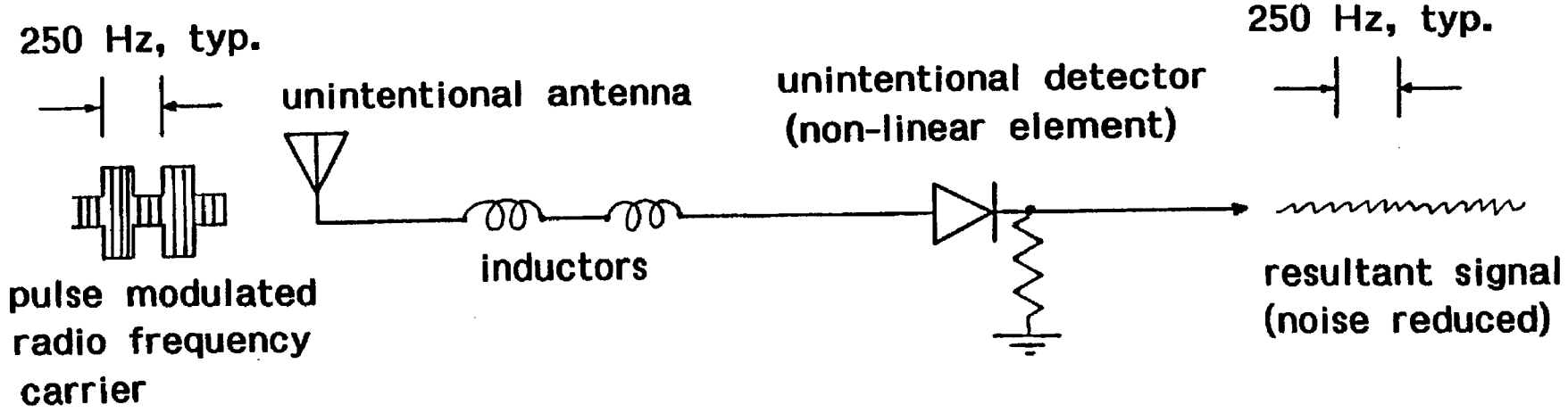
FIG. 3 shows how the electromagnetic interference can be reduced or eliminated by adding one or more inductors in series with the internal wire which acts as an unintentional antenna. Ferrite beads can also be used in place of the inductors shown.

The internal components 12 of the hearing aid must also be sometimes modified so that the 800 MHz–1000 MHz radio signals produced by the cellular telephones cannot pass effectively from one component to another. This is done in such a way that the normal functions of the hearing aid are not adversely affected. Some or all of the following techniques are employed:

12*a*: The addition of one or more inductors 13 in series. FIG. 2 depicts a pulse modulated radio signal such as those produced by some cellular telephones. This signal is unintentionally picked up by an internal wire, acting as an unintentional antenna. The signal is then demodulated and detected by one of the nonlinear elements of the hearing aid, such as the audio amplifier. As shown in FIG. 3, by adding one or more inductors in series with the unintentional antenna, the incoming radio signal is blocked by the high impedance of the inductors. The inductors present a low impedance to the intended audio signals, which pass through intact.

Figure 1:
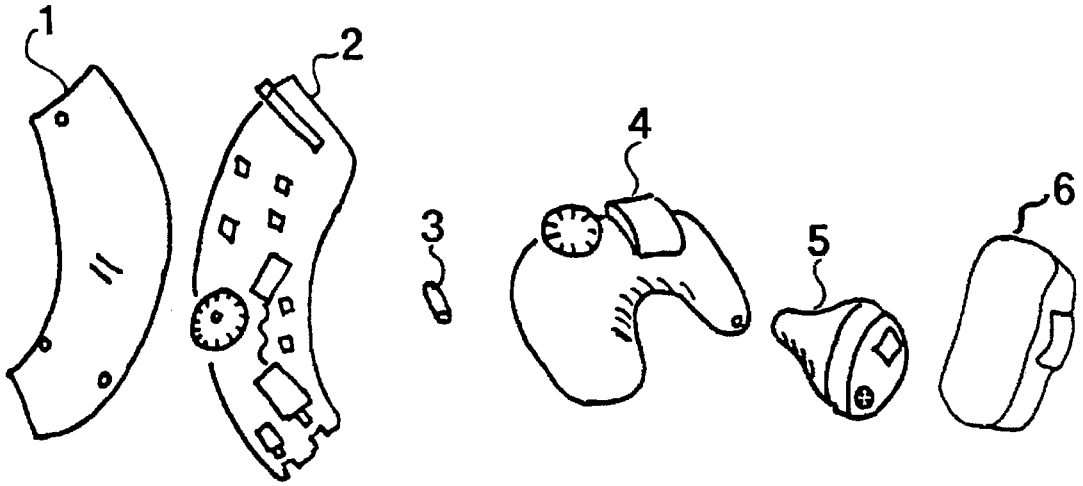
Figure 1 (Prior Art)
FIG. 1 (Prior Art) shows a Behind The Ear hearing aid 1 and 2, an In The Ear hearing aid 4, In The Canal hearing aids 5 & 6 and a miniature ferrite bead 3 which can be used in this invention. The Completely In The Canal hearing aid is not shown.

12*b*: The Addition of Ferrite beads 14: Ferrite beads, such as model #2673008501 made by Fair-Rite Inc. of Wallkill, N.Y. and depicted as item #3 in FIG. 1, when slipped over an internal wire effectively add an inductor in series as described in 12*a* above. Other shapes of the Ferrite material, such as toroids, rods, and custom molded shapes may be used.

Figure 4:
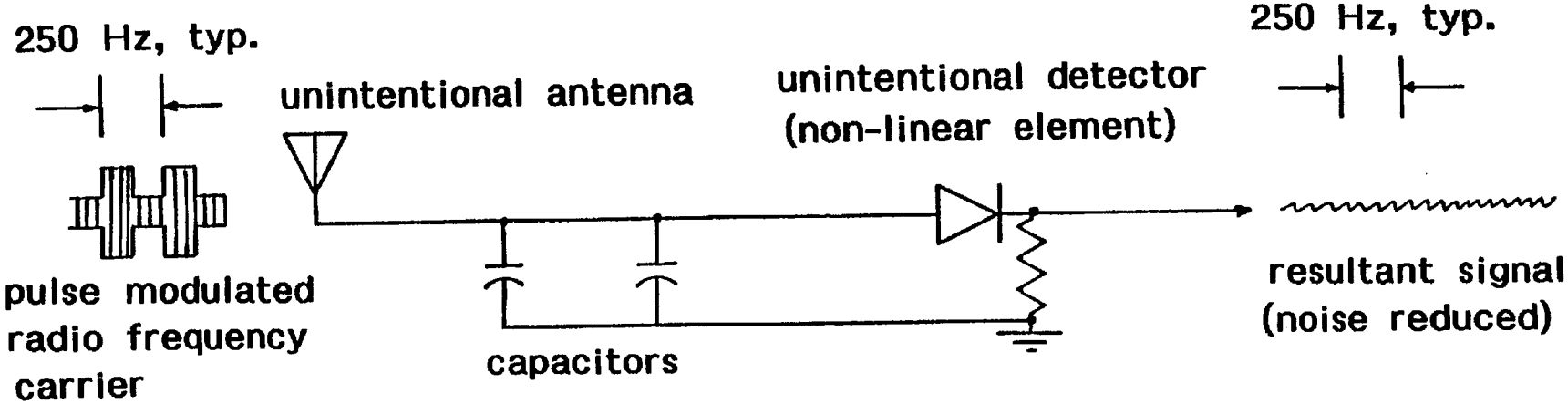
FIG. 4 shows how the electromagnetic interference can be reduced or eliminated by adding one or more capacitors in parallel with the internal wire which acts as an unintentional antenna.
Figure 5:
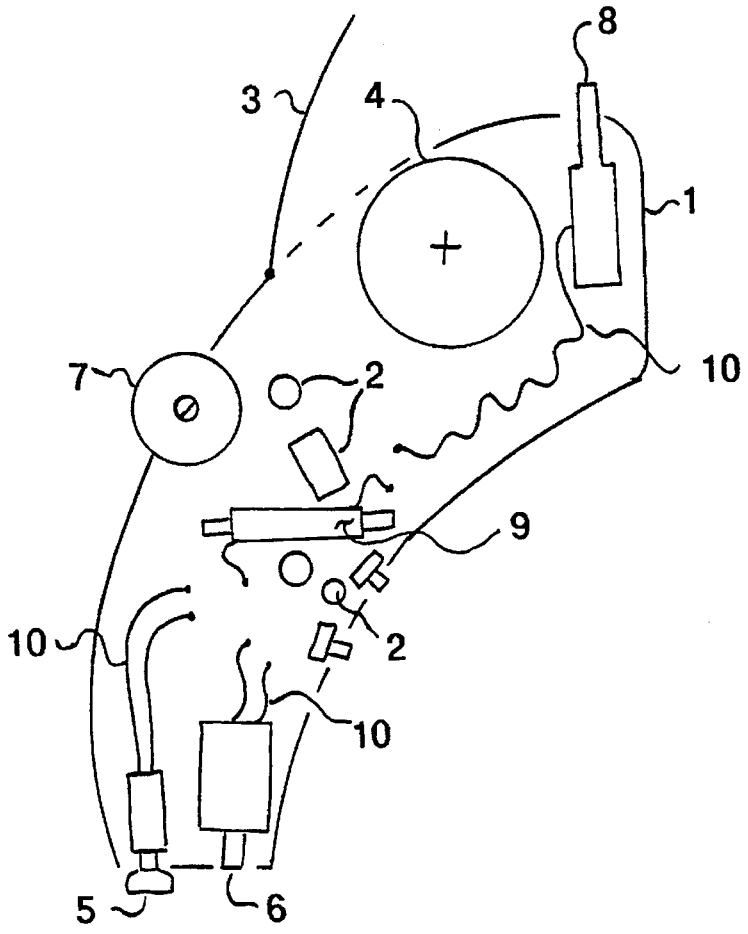
Figure 5 (Prior Art)
FIG. 5 (Prior Art) mechanically and schematically illustrates the elements which comprise a hearing aid. A Behind The Ear hearing aid is used for the illustration, but the same elements apply to In The Ear, In The Canal, and Completely In The Canal hearing aids, the only difference being one of size and shape.
Figure 5:
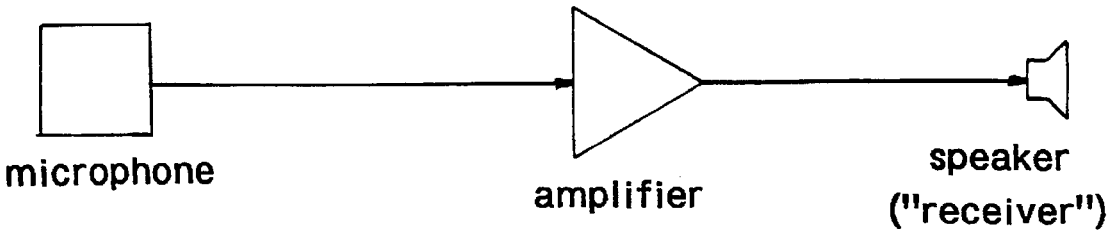
Figure 5 (Prior Art)

12*c*: The addition of one or more capacitors in parallel: As shown in FIG. 4, the addition of one or more capacitors in parallel with the unintentional antenna has the same de-coupling effect as the addition of inductors in series. In this case, the capacitors present a very low impedance to the radio signal, shorting it to ground. The capacitors present a high impedance to the audio signals, which pass through intact.

Figure 6:
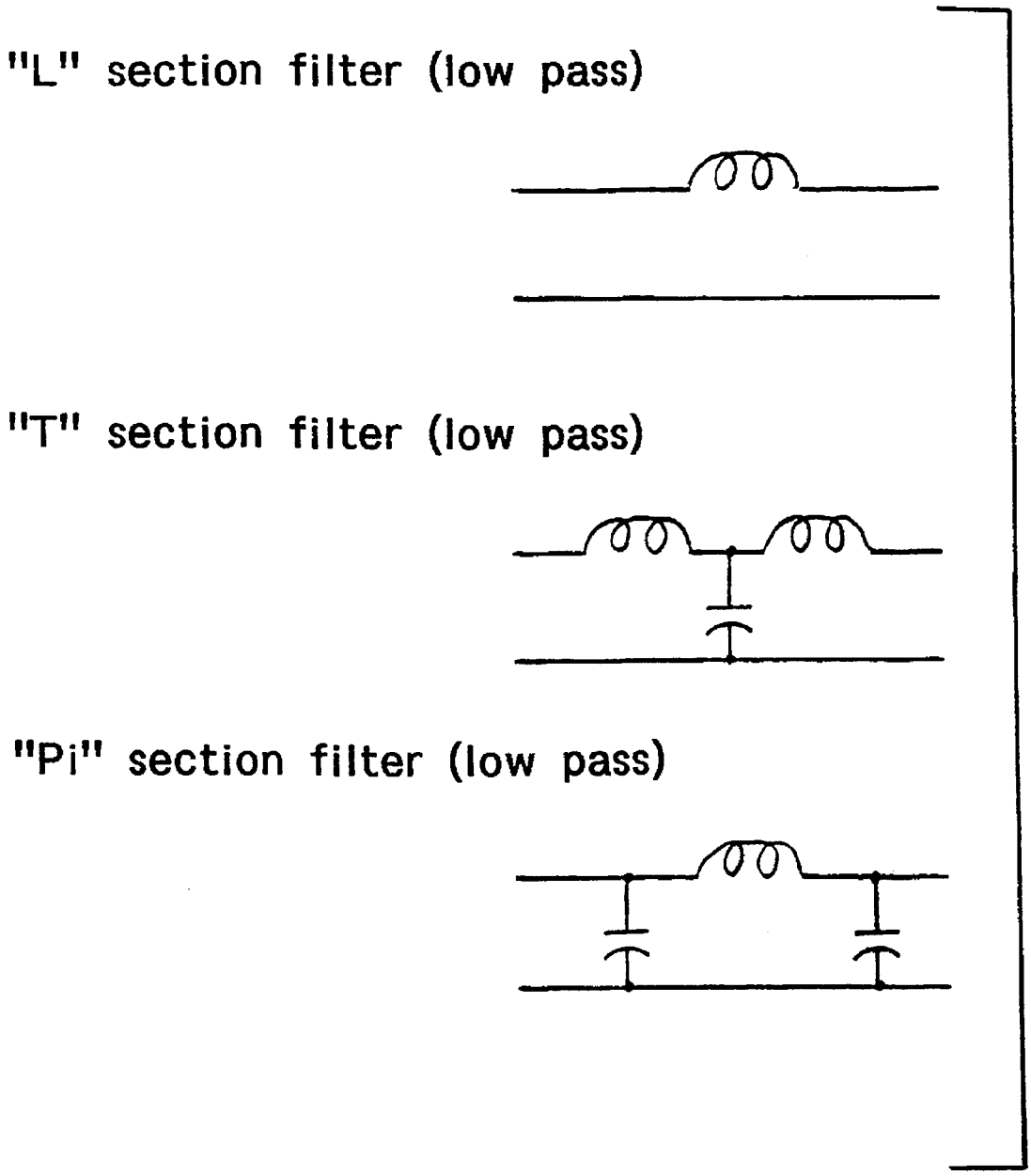
Figure 6 (Prior Art)
FIG. 6 (Prior Art) Illustrates various ways in which inductors and capacitors can be arranged to form low-pass filters. Ferrite beads can be used in place of the inductors shown.

12*d*: Filtering: This consists of adding combinations of inductors (including ferrites) and capacitors as described in FIG. 6.

Hearing aids range from simple audio amplifiers to complex devices employing digital signal processing techniques. Each design presents a slightly different problem and some or all of the above protection techniques will be used. Because of the many openings that a hearing aid must have, it is impossible to shield its outer case 11 completely. The high field strengths and Ultra-High Frequencies produced by cellular telephones will usually leak through the openings, requiring supplemental protection in the form of a combination of the above techniques.

The preferred embodiment is described in claim 11.

The resultant hearing aid will be unaffected by the radio signals produced by cellular telephones, allowing hearing impaired people to take advantage of cellular telephones and other personal communication devices while wearing their hearing aids.

What is claimed is:

1. A behind the ear, in the ear, all in the ear, in the canal or completely in the canal hearing aid consisting: a case, internal components, a battery door, a battery, a microphone, a speaker a volume control, a telephone coil activation switch, a telephone coil, and internal wires;

the internal wires are made resistant to electromagnetic interference produced by cellular telephones in the 800 MHz to 1000 MHz frequency range by lining the case with an electrically conductive material;

one or more inductors or ferrite devices are put in series with some of the internal wires or components;

one or more capacitors are put in parallel with some of the internal wires or components;

the internal components are shielded from electromagnetic interference with electrically conductive foil, and conductive gaskets.

2. A Hearing aid as in claim 1 wherein the case is painted with an electrically conductive paint.

3. A Hearing Aid as in claim 1 wherein the case is made of an electrically conductive plastic.

* * * * *

US005640457C1

(12) REEXAMINATION CERTIFICATE (4833rd)

United States Patent

Gnecco et al.

(10) Number: US 5,640,457 C1

(45) Certificate Issued: Aug. 19, 2003

(54) ELECTROMAGNETICALLY SHIELDED HEARING AID

(76) Inventors: Louis Thomas Gnecco, 112-F Elden St., Herndon, VA (US) 22070; Paula Sharyn Gnecco, 112-F Elden St., Herndon, VA (US) 22070

Reexamination Request:
No. 90/005,608, Jan. 7, 2000

Reexamination Certificate for:

| | |
|---|---|
| Patent No.: | **5,640,457** |
| Issued: | **Jun. 17, 1997** |
| Appl. No.: | **08/557,999** |
| Filed: | **Nov. 13, 1995** |

(51) Int. Cl.[7] ..... H04R 25/00

(52) U.S. Cl. ..... 381/322; 174/35 R

(58) Field of Search ..... 381/316, 321, 381/322, 324, 325, 326, 312, 313, 314, 317, 318, 93, 94.1, 911

(56) References Cited

U.S. PATENT DOCUMENTS 5,708,720 A 1/1998 Meyer

OTHER PUBLICATIONS

EMC for Product Designers, Butterworth–Heinemann Ltd. 1992, pp. 4–5, 10–11, 122–139, 147–150, 155–158, 166–169, 182–185, 194–195, 199–212.

Interference to Hearing Aids by the new Digital Mobile Telephone System, Global System for Mobile (GSM) Communications Standard, Joyner et al, published by National Acoustic Laboratories, Mar. 30, 1993 ("Joyner et al").

"Oticontact" No. 13, Oct. 1993.

*Primary Examiner*—Rexford Barnie

(57) ABSTRACT

A behind the ear, in the ear, all in the ear, in the canal, or completely in the canal hearing aid which is made resistant to electromagnetic interference produced by cellular telephones in the 800 MHz to 1000 MHz frequency range. The resultant hearing aid will allow hearing imparied people to take advantage of cellular telephones and other recently-developed personal communication devices while also using their hearing aids.

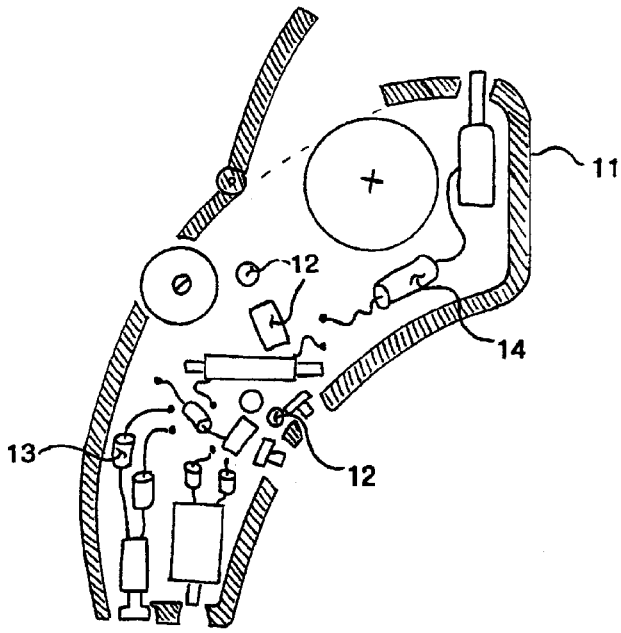

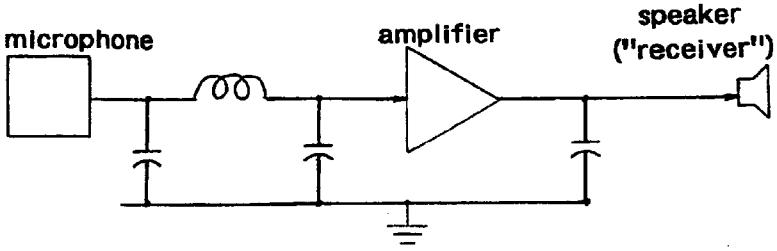

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–3 is confirmed.

* * * * *

US005640457C2

(12) EX PARTE REEXAMINATION CERTIFICATE (7141st)

United States Patent
Gnecco et al.

(10) Number: US 5,640,457 C2
(45) Certificate Issued: Nov. 3, 2009

(54) ELECTROMAGNETICALLY SHIELDED HEARING AID

(75) Inventors: Louis Thomas Gnecco, Herndon, VA (US); Paula Sharyn Gnecco, Herndon, VA (US)

(73) Assignee: Acacia Patent Acquisition Corporation, Newport Beach, CA (US)

Reexamination Request:
No. 90/008,607, Jun. 8, 2007

Reexamination Certificate for:

| | |
|---|---|
| Patent No.: | **5,640,457** |
| Issued: | **Jun. 17, 1997** |
| Appl. No.: | **08/557,999** |
| Filed: | **Nov. 13, 1995** |

Reexamination Certificate C1 5,640,457 issued Aug. 19, 2003

(51) Int. Cl.
*H04R 25/00* (2006.01)

(52) U.S. Cl. ..... 381/322; 174/350; 381/312; 381/317; 361/816; 361/818; 455/283

(58) Field of Classification Search ..... None
See application file for complete search history.

(56) References Cited

U.S. PATENT DOCUMENTS

| | | | | |
|---|---|---|---|---|
| 4,956,868 | A | 9/1990 | Carlson | 381/322 |
| 5,657,199 | A | 8/1997 | Devoe et al. | 361/328 |
| 5,708,720 | A | 1/1998 | Meyer | 381/322 |

FOREIGN PATENT DOCUMENTS

| | | |
|---|---|---|
| DE | 4343703 | 1/1995 |
| DE | 4343703 C1 * | 1/1995 |

OTHER PUBLICATIONS

Derwent–Acc–No. 1995–031222 (English Abstract of German Patent DE–4343703 to Meyer, Dec. 21, 1993).*

LeStrange, R. et al., Interference to Hearing Aids by the Digital Mobile Telephone System, Global System for Mobile Communications, (GSM), *National Acoustic Laboratories Report No. 131*, 1995, 110 pages.

Joyner et al., "Interference to Hearing Aids by the New Digital Mobile Telephone System, Global System for Mobile (GSM) Communications Standard," *Nt'l Acoustic Laboratories*, 1993, Appendix to 1995 NAL Report No. 13, 1–13.

* cited by examiner

*Primary Examiner*—Anjan K. Deb

(57) ABSTRACT

A behind the ear, in the ear, all in the ear, in the canal, or completely in the canal hearing aid which is made resistant to electromagnetic interference produced by cellular telephones in the 800 MHz to 1000 MHz frequency range. The resultant hearing aid will allow hearing impaired people to take advantage of cellular telephones and other recently-developed personal communication devices while also using their hearing aids.

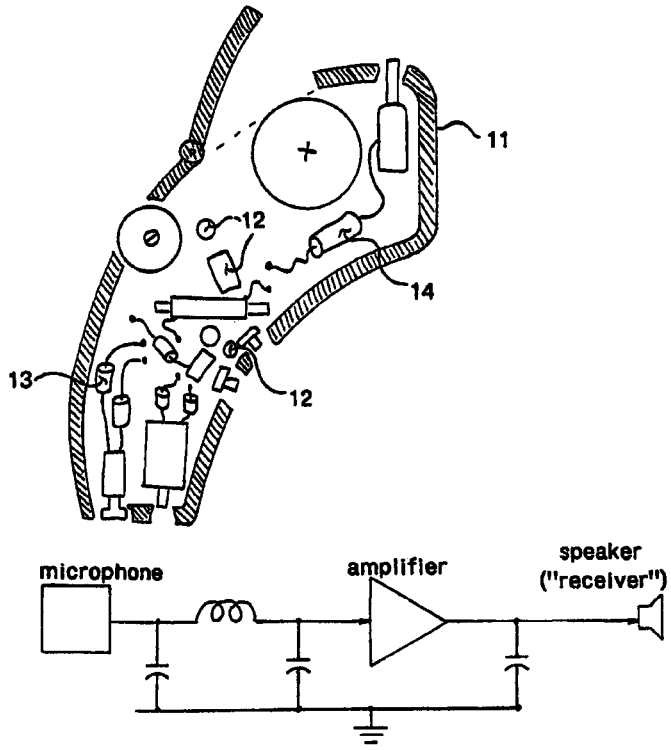

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are determined to be patentable as amended.

1. A behind the ear, in the ear, all in the ear, in the canal or completely in the canal hearing aid consisting:

a case, internal components, a battery door, a battery, a microphone, a speaker a volume control, a telephone coil activation switch, a telephone coil, and internal wires*, the case being made of an electrically conductive plastic*;

the internal wires are made resistant to *unwanted radio signals including* electromagnetic interference produced by cellular telephones in the 800 MHz to 1000 MHz frequency range by lining the case with an electrically conductive material;

one or more inductors or ferrite devices are put in series with some of the internal wires or components *to inhibit the internal wires from acting as unintentional antennas to the unwanted radio signals, the one or more inductors or ferrite devices adapted to provide high impedance to the unwanted radio signals and block passage thereof in the internal wires*; *and* one or more capacitors are put in parallel with some of the internal wires or components *to inhibit the internal wires from acting as the unintentional antennas to the unwanted radio signals, the one or more capacitors adapted to provide low impedance to the unwanted radio signals and short the unwanted radio signals in the internal wires to ground*;

the internal components are shielded from electromagnetic interference with electrically conductive foil, and conductive gaskets.

2. A [Hearing] *hearing* aid as in claim 1 wherein the case is painted with an electrically conductive paint.

3. A [Hearing Aid ] *hearing aid* as in claim 1 wherein the [case is made of an] electrically conductive plastic *is impregnated with one of metal and carbon*.

* * * * *